US009651886B2

(12) United States Patent
Kawauchi et al.

(10) Patent No.: US 9,651,886 B2
(45) Date of Patent: May 16, 2017

(54) CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

(75) Inventors: Takeshi Kawauchi, Okayama (JP); Tomohide Iida, Okayama (JP)

(73) Assignees: DOWA ELECTRONICS MATERIALS CO., LTD., Tokyo (JP); DOWA IP CREATION CO., LTD., Okayama, Okayama (JP)

( * ) Notice: Subject to any disclaimer, the term of this patent is extended or adjusted under 35 U.S.C. 154(b) by 0 days.

(21) Appl. No.: 14/423,227

(22) PCT Filed: Aug. 30, 2012

(86) PCT No.: PCT/JP2012/072023

§ 371 (c)(1),
(2), (4) Date: Feb. 23, 2015

(87) PCT Pub. No.: WO2014/033875

PCT Pub. Date: Mar. 6, 2014

(65) Prior Publication Data

US 2015/0220014 A1 Aug. 6, 2015

(51) Int. Cl.

| | |
|---|---|
| ***G03G 9/107*** | (2006.01) |
| ***G03G 9/113*** | (2006.01) |
| ***G03G 9/08*** | (2006.01) |
| ***G03G 5/10*** | (2006.01) |

(52) U.S. Cl.

CPC ..... *G03G 9/1075* (2013.01); *G03G 5/107* (2013.01); *G03G 9/0815* (2013.01); *G03G 9/107* (2013.01); *G03G 9/113* (2013.01); *G03G 9/1132* (2013.01); *G03G 9/1136* (2013.01)

(58) Field of Classification Search

CPC ..... G03G 9/10; G03G 9/107; G03G 9/1075
See application file for complete search history.

(56) References Cited

FOREIGN PATENT DOCUMENTS

| | | | |
|---|---|---|---|
| JP | 10-116717 | 5/1998 | |
| JP | 2006-259294 | 9/2006 | |
| JP | 2008-241742 | 10/2008 | |
| JP | 2011-207656 | 10/2011 | |
| JP | 2012-076955 | * 4/2012 | ..... G03G 9/107 |
| WO | 2011/125647 | 10/2011 | |
| WO | 2012/049900 | 4/2012 | |

OTHER PUBLICATIONS

Translation of JP 2012-076955 published Apr. 2012.*

* cited by examiner

*Primary Examiner* — Peter Vajda
(74) *Attorney, Agent, or Firm* — Clark & Brody

(57) ABSTRACT

This invention is directed to a method for manufacturing carrier core particles for electrophotographic developer containing iron, manganese, and calcium as a core composition. The method includes (A) a mixing step of mixing an iron-containing raw material, a manganese-containing raw material, and a calcium-containing raw material to prepare a mixture thereof, (C) a granulation step of granulating the mixture after the mixing step, and (D) a firing step of firing a powdery material, which is obtained by granulating the mixture in the granulation step, at a predetermined temperature to form a magnetic phase. The calcium-containing raw material is provided in a granular form, and primary particles of the calcium-containing raw material have a volume mean diameter of 1 μm or less.

4 Claims, 4 Drawing Sheets

CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

TECHNICAL FIELD

This invention relates to a method for manufacturing carrier core particles for electrophotographic developer (hereinafter, sometimes simply referred to as "carrier core particles"), the carrier core particles for electrophotographic developer, carrier for electrophotographic developer (hereinafter, sometimes simply referred to as "carrier"), and electrophotographic developer (hereinafter, sometimes simply referred to as "developer"). More particularly, this invention relates to carrier core particles contained in electrophotographic developer used in copying machines, MFPs (Multifunctional Printers) or other types of electrophotographic apparatuses, a method for manufacturing the carrier core particles, carrier in the electrophotographic developer and the electrophotographic developer.

BACKGROUND ART

Electrophotographic dry developing systems employed in copying machines, MFPs or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a rotatable magnet roller with a plurality of south and north poles alternately arranged thereon in the circumferential direction and an agitation roller for agitating and mixing the toner and carrier in the developing apparatus. The carrier made of magnetic powder is carried by the magnet roller. The magnetic force of the magnet roller forms a straight-chain-like magnetic brush of carrier particles. Agitation produces triboelectric charges that attract a plurality of toner particles to the surfaces of the carrier particles. The magnetic brush abuts against the photoreceptor with rotation of the magnet roller to supply the toner to the surface of the photoreceptor. Development with the two-component developer is carried out as described above.

Fixation of the toner on a sheet of paper results in successive consumption of toner in the developing apparatus, and new toner in the same amount as that of the consumed toner is supplied, whenever needed, from a toner hopper attached to the developing apparatus. On the other hand, the carrier is not consumed for development and is used as it is until the carrier comes to the end of its life. The carrier, which is a component of the two-component developer, is required to have various functions including: a function of triboelectrically charging the toner by agitation in an effective manner; insulation properties; and a toner transferring ability to appropriately transfer the toner to the photoreceptor. To improve the toner's chargeability, for example, the carrier is required to have appropriate electric resistance (hereinafter, sometimes simply referred to as "resistance") and appropriate insulation properties.

The recently dominating carrier includes carrier core particles, which are the cores or the hearts of the carrier particles, and coating resin that covers the surfaces of the carrier core particles.

The carrier core particles are desired to have good magnetic properties. Briefly speaking, the carrier is carried as described above by magnet rollers with magnetic force in the developing apparatus. Under this usage, if the magnetism, more specifically, the magnetization of the carrier core particles is low, the retention of the carrier to the magnet rollers becomes low, which may cause so-called scattering of the carrier or other problems. Especially, recent tendencies to make the diameter of toner particles smaller in order to meet the demand for high-quality image formation tend to require smaller carrier particles. However, the downsizing of the carrier particles could lead to reduction in the retention of each carrier particle. Effective measures are required to prevent the scattering of the carrier.

Among various disclosed techniques relating to carrier core particles, Japanese Unexamined Patent Application Publication No. 2008-241742 (PTL1) discloses a technique with the aim of preventing the carrier from scattering.

CITATION LIST

Patent Literature

PTL1: Japanese Unexamined Patent Application Publication No. 2008-241742

SUMMARY OF INVENTION

Technical Problem

Carrier core particles are required to have good electrical properties, more specifically, for example, to be capable of holding a large amount of electric charges and having a high dielectric breakdown voltage. In addition, the carrier core particles are desired to have an appropriate resistance value as described above.

Especially, there has been a growing trend in recent years to require improvement of the charging performance of the carrier core particles, more specifically, an increase in the amount of charges the carrier core particles can hold. As described above, the carrier core particles are often covered with coating resin before use; however, stress or other forces caused by agitation in a developing apparatus may sometimes peel part of the coating resin and resultantly expose the surfaces of the carrier core particles. Under these circumstances, it is strongly required that the exposed surfaces of the carrier core particles are triboelectrically charged through friction with toner. Of course, it is preferable that carrier core particles have good magnetic properties and other properties.

An object of the present invention is to provide a method for manufacturing carrier core particles for electrophotographic developer having high charging performance and good properties. Another object of the present invention is to provide carrier core particles for electrophotographic developer having high charging performance and good properties.

Yet another object of the present invention is to provide carrier for electrophotographic developer having high charging performance and good properties.

Yet another object of the present invention is to provide electrophotographic developer capable of forming images of excellent quality.

Solution to Problem

For the purpose of improving charging performance of carrier core particles, the inventors of the present invention conceived to add calcium (Ca), which is a metal element, as a component of the core composition to improve the triboelectric chargeability on the surfaces of the carrier core particles. In addition, the inventors of the invention found the necessity for the calcium contained as an component of the carrier core particles not only to exhibit good dispersibility over the surfaces of the particles, but also to disperse well inside the carrier core particles, as described below. Specifically, the inventors conceived that if calcium can form a good solid solution with a spinel structure that is formed with iron (Fe) and manganese (Mn) as main components inside the carrier core particles, the lattice constant of the crystals making up the carrier core particles is increased and the increased lattice constant imparts a property to retain electric charges to the particles, resulting in improvement of the charging performance of the carrier core particles. Also, the inventors conceived that conventional pretreatments, such as calcination and pulverization, performed on calcium to be added as a calcium-containing raw material is not enough to increase the dispersion degree of the calcium-containing raw material and calcium needs to be dispersed on the order of atoms or microns.

Thus, the method for manufacturing the carrier core particles for electrophotographic developer according to the invention is directed to a method for manufacturing carrier core particles containing iron, manganese, and calcium as a core composition. The method includes a mixing step of mixing an iron-containing raw material, a manganese-containing raw material, and a calcium-containing raw material to prepare a mixture thereof, a granulation step of granulating the mixture after the mixing step, and a firing step of firing a powdery material, which is obtained by granulating the mixture in the granulation step, at a predetermined temperature to form a magnetic phase. In this manufacturing method, the calcium-containing raw material is provided in a granular form, and primary particles of the calcium-containing raw material have a volume mean diameter of 1 μm or less.

The carrier core particles manufactured in the above-described manufacturing method contain well dispersed calcium both on the surface and in the interior thereof. Therefore, the manufactured carrier core particles inherently have high charging performance and therefore have excellent properties.

Preferably, the mixing step can be configured to include a step of mixing the calcium-containing raw material in a solution state. This configuration can effectively suppress the occurrence of aggregates of the added calcium-containing raw material and more reliably improve the dispersibility of calcium in the carrier core particles.

More preferably, the mixing step includes a step of mixing at least one selected from the group consisting of calcium nitrate, calcium acetate, and calcium carbonate as the calcium-containing raw material. The calcium-containing raw material selected from the group can relatively easily provide primary particles with the aforementioned volume mean diameter.

In a still preferable embodiment, the mixing step may include a step of mixing a magnesium-containing raw material. The carrier core particles containing the magnesium-containing raw material can further enhance their magnetic properties.

In another aspect of the present invention, the carrier core particles for electrophotographic developer contain iron, manganese, and calcium as a core composition and are manufactured by mixing an iron-containing raw material, a manganese-containing raw material, and a calcium-containing raw material to prepare a mixture, granulating the mixture, and firing the granules at a predetermined temperature to form a magnetic phase. The calcium-containing raw material is provided in a granular form, and primary particles of the calcium-containing raw material have a volume mean diameter of 1 μm or less.

The carrier core particles for electrophotographic developer contain well dispersed calcium, as a component of the carrier core particles, both on the surface and in the interior thereof, and therefore, have high charging performance and excellent properties.

In addition, the carrier core particles for electrophotographic developer according to the invention contain iron, manganese, and calcium as a core composition and have a lattice constant higher than 8.490. Such carrier core particles contain calcium forming a good solid solution with a spinel structure, and therefore the properties are excellent.

The carrier core particles for electrophotographic developer according to the invention contain iron, manganese, and calcium as a core composition, and when observing a cross section of the carrier core particles for electrophotographic developer that is magnified 3000 times by an electron microscope and mapped for a calcium element by an EDX (Energy Dispersive X-ray Spectroscopy), calcium-segregated regions account for 4% or less of the entire cross section.

In yet another aspect of the invention, carrier for electrophotographic developer used in developer to develop electrophotographic images includes any of the aforementioned carrier core particles for electrophotographic developer and resin that coats the surface of the carrier core particles for electrophotographic developer.

Such carrier for electrophotographic developer has high charging performance and therefore has excellent properties.

In yet another aspect of the present invention, electrophotographic developer used to develop electrophotographic images includes the carrier for electrophotographic developer and toner that can be triboelectrically charged by frictional contact with the carrier for development of electrophotographic images.

The electrophotographic developer including the carrier for electrophotographic developer having the aforementioned composition can form images of high quality.

Advantageous Effects of Invention

Such carrier core particles for electrophotographic developer of the present invention inherently have high charging performance and therefore have excellent properties.

Also, the carrier for electrophotographic developer of the present invention has high charging performance and therefore has excellent properties.

The electrophotographic developer of the present invention can form images of high quality.

DESCRIPTION OF EMBODIMENT

With reference to the drawings, an embodiment of the present invention will be described below. First, a description about carrier core particles according to the embodiment of the invention will be given. The carrier core particles according to the embodiment of the invention are roughly spherical in shape. The carrier core particles according to the embodiment have a diameter of approximately 35 μm and an appropriate particle size distribution. Specifically, the particle diameter refers to a volume mean diameter. The particle diameter and particle size distribution are set to any values to meet required properties and manufacturing yield of the developer. On the surface of the carrier core particles, there are fine irregularities that are formed mainly in a firing step, which will be described later.

Carrier particles according to the embodiment of the invention are also roughly spherical in shape like the carrier core particles. The carrier particles are made by coating, or covering, the carrier core particles with a thin resin film and have almost the same diameter as the carrier core particles. The surfaces of the carrier particles are almost completely covered with resin, which is different from the carrier core particles.

Developer according to the embodiment of the invention includes the aforementioned carrier and toner. Toner particles are also roughly spherical in shape. The toner particles contain mainly styrene acrylic-based resin or polyester-based resin and a predetermined amount of pigment, wax and other ingredients combined therewith. Such toner particles are manufactured by, for example, a pulverizing method or polymerizing method. The toner particles in use are, for example, approximately 5 μm in diameter, which is about one-seventh of the diameter of the carrier particles. The compounding ratio of the toner and carrier is also set to any value according to the required developer properties. Such developer is manufactured by mixing predetermined amounts of carrier and toner by a suitable mixer.

Figure 1:
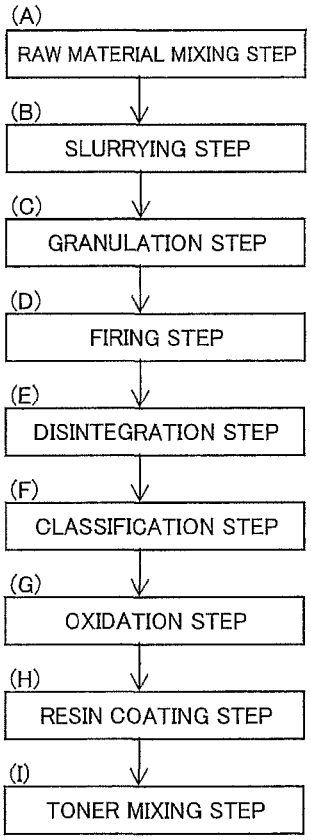
FIG. 1 is a flow chart showing the main steps of a method for manufacturing carrier core particles according to an embodiment of the invention.

Next, a method for manufacturing the carrier core particles according to the embodiment of the invention will be described. FIG. 1 is a flow chart showing the main steps of the method for manufacturing the carrier core particles according to the embodiment of the invention. Along FIG. 1, the method for manufacturing the carrier core particles according to the embodiment of the invention will be described below.

First, a raw material containing iron, a raw material containing manganese, a raw material containing calcium, and a raw material containing magnesium are prepared. The prepared raw materials are formulated at an appropriate compounding ratio to meet the required properties, and then mixed (FIG. 1(A)). The appropriate compounding ratio in this embodiment is set so that the resultant carrier core particles are made at the compounding ratio.

The iron-containing raw material making up the carrier core particles according to the embodiment of the invention can be metallic iron or an oxide thereof, and more specifically, preferred materials include $Fe_2O_3$, $Fe_3O_4$, and Fe, which can stably exist at room temperature and atmospheric pressure. The manganese-containing raw material can be manganese metal or an oxide thereof, and more specifically, preferred materials include Mn metal, $MnO_2$, $Mn_2O_3$, $Mn_3O_4$ and $MnCO_3$, which can stably exist at room temperature and atmospheric pressure. The magnesium-containing raw material can be magnesium metal or an oxide thereof, and more specifically, preferred materials include, for example, $MgCO_3$, which is a carbonate, $Mg(OH)_2$, which is a hydroxide, and MgO, which is an oxide. The calcium-containing raw material can be calcium metal or an oxide thereof, and more specifically, preferred materials include, for example, $CaCO_3$, which is a carbonate, $Ca(OH)_2$, which is a hydroxide, and CaO, which is an oxide. The raw materials (iron-containing raw material, manganese-containing raw material, calcium-containing raw material, magnesium-containing raw material, etc.) can be calcined and pulverized individually or all together after being mixed so as to have the target composition.

In this embodiment, the calcium-containing raw material is provided in a granular form, and the primary particles of the calcium-containing raw material preferably have a volume mean diameter of 1 μm or less. Such calcium-containing raw material having small particle diameters has excellent dispersibility in the carrier core particles.

In addition, this manufacturing method can be configured to include a step of mixing the calcium-containing raw material in a solution state. This configuration can effectively suppress the occurrence of aggregates of the added calcium-containing raw material and can more reliably improve the dispersibility of the calcium in the carrier core particles.

A description will be made below about measurement of the volume mean diameter of primary particles of the calcium-containing raw material. The calcium-containing raw material to be used was added to water at a ratio of 1 g (calcium-containing raw material) to 100 ml (water) and subjected to a treatment for 1 minute in an ultrasonic cleaner (output power: 100 W, frequency: 50 Hz). The resultant dispersion solution was measured by a laser diffraction particle size distribution analyzer (Microtrac, Model 9320-X100 produced by NIKKISO CO., LTD.). Since the finer particles have a stronger tendency to aggregate, aggregated powder was first monodispersed with the use of a dispersant, and then was measured. Calcium nitrate and calcium acetate have a high degree of solubility and can become dissolved in solution, and therefore were set to have primary particles with a volume mean diameter of 0.01 μm or less.

The mixing step includes a step of mixing at least one selected from the group consisting of calcium nitrate, calcium acetate, and calcium carbonate, as a calcium-containing raw material. Selecting a calcium-containing raw material from such a group can relatively easily provide a calcium-containing raw material having the aforementioned volume mean diameter.

Then, the mixed materials are slurried (FIG. 1(B)). Specifically, the materials are weighed out to meet the target composition of the carrier core particles and are mixed to obtain a slurried material.

In the manufacturing steps for manufacturing the carrier core particles according to the invention, a reduction agent may be further added to the aforementioned slurried material to accelerate a reduction reaction to be induced in a part of a firing step, which will be described later. A preferred reducing agent may be carbon powder, polycarboxylic acid-based organic substance, polyacrylic acid-based organic substance, maleic acid, acetic acid, polyvinyl alcohol (PVA)-based organic substance, or mixtures thereof.

Water is added to the slurried material that is then mixed and agitated so as to adjust the solid concentration to 40 wt % or higher, preferably 50 wt % or higher. The slurried material containing 50 wt % or higher solid is preferable because such a material can maintain strength when it is granulated into pellets.

Subsequently, the slurried material is granulated (FIG. 1(C)). Granulation of the slurry, which was obtained by mixing and agitation, is performed with a spray drier. Note that it may be preferable to subject the slurry to wet pulverization before the granulation step.

The temperature of an atmosphere during spray drying can be set to approximately 100° C. to 300° C. This can provide granulated powder whose particles are approximately 10 to 200 μm in diameter. In consideration of the final diameter of the particles as a product, it is preferable to filter the obtained granulated powder by a vibrating sieve or the like to remove coarse particles and fine powder for particle size adjustment at this point in time.

Subsequently, the granulated material is fired (FIG. 1(D)). Specifically, the obtained granulated powder is loaded in a furnace heated to approximately 900° C. to 1500° C. and fired for 1 to 24 hours to produce a target fired material. At this point, the oxygen concentration in the firing furnace can be set to any values, but should be enough to advance ferritization reaction. Concretely, if the temperature of the furnace is 1200° C., a gas is introduced and flows in the furnace to adjust the oxygen concentration to $10^{-7}$% to 3%.

In addition, the reduction atmosphere required for ferritization can be controlled by adjusting the amount of the aforementioned reducing agent. To achieve reaction speed ensuring sufficient productivity in industrialization, the preferable temperature is 900° C. or higher. On the other hand, a firing temperature of 1500° C. or lower does not cause excessive sintering between particles, and therefore the resultant fired material remains in the form of powder.

The core composition can be changed to contain a slightly excess amount of oxygen. One of the possible measures to have the core composition contain a slightly excess amount of oxygen is to set the oxygen concentration in a cooling process of the firing step to a predetermined value or higher. Specifically, in the firing step, the fired material is cooled down to approximately room temperature in an atmosphere with a predetermined oxygen concentration, concretely, with an oxygen concentration of higher than 0.03%. More specifically, a gas with an oxygen concentration of higher than 0.03% is introduced into and continues flowing in the electric furnace. The carrier core particles manufactured in this manner can have a slightly excess amount of oxygen in ferrite in the inner layers thereof. When the oxygen concentration of the gas is 0.03% or lower, the oxygen content of the inner layers becomes relatively low. Therefore, in this embodiment, the fired material is cooled down in an atmosphere with the aforementioned oxygen concentration.

It is preferable at this stage to control the particle size of the fired material. For example, the fired material is coarsely ground by a hammer mill or the like. In other words, the fired granules are disintegrated (FIG. 1(E)). After disintegration, classification is carried out with a vibrating sieve or the like. In other words, the disintegrated granules are classified (FIG. 1(F)). Through these steps, carrier core particles having a desired size can be obtained.

Then, the classified granules undergo oxidation (FIG. 1(G)). The surfaces of the carrier core particles obtained at this stage are heat-treated (oxidized). Then, the particle's breakdown voltage is increased to 250 V or higher, thereby imparting appropriate electric resistance of $1\times10^{6}$ to $1\times10^{13}$ Ω·cm to the carrier core particles. Increasing the electric resistance of the carrier core particles through oxidation results in reduction of carrier scattering caused by charge leakage.

More specifically, the granules are heat-treated in an atmosphere with an oxygen concentration of 10% to 100%, at a temperature of 200° C. to 700° C., for 0.1 to 24 hours to obtain the target carrier core particles. More preferably, the granules are heat-treated at a temperature of 250° C. to 600° C. for 0.5 to 20 hours, further more preferably, at a temperature of 300° C. to 550° C. for 1 to 12 hours. Note that the oxidation step is optionally executed when necessary.

Thus, the carrier core particles according to the embodiment of the invention are manufactured. In short, the method for manufacturing the carrier core particles for electrophotographic developer according to the embodiment of the invention is directed to a method for manufacturing carrier core particles containing iron, manganese, and calcium as a core composition, and the method includes a mixing step of mixing an iron-containing raw material, a manganese-containing raw material, and a calcium-containing raw material to prepare a mixture thereof, a granulation step of granulating the mixture after the mixing step, and a firing step of firing a powdery material, which is obtained by granulating the mixture in the granulation step, at a predetermined temperature to form a magnetic phase. The calcium-containing raw material is provided in a granular form, and primary particles of the calcium-containing raw material have a volume mean diameter of 1 μm or less. The carrier core particles manufactured by the aforementioned method contain calcium well dispersed both on the surface and in the interior thereof, and therefore, have high charging performance and excellent properties, as described above.

In addition, the carrier core particles for electrophotographic developer according to the embodiment of the invention contain iron, manganese, and calcium as the core composition and are manufactured by granulating a mixture of the iron-containing raw material, manganese-containing raw material, and calcium-containing raw material and firing the granules at a predetermined temperature to form a magnetic phase. The calcium-containing raw material is provided in a granular form, and primary particles of the calcium-containing raw material have a volume mean diameter of 1 μm or less. The carrier core particles for electrophotographic developer contain calcium, as a component of the carrier core particles, well dispersed both on the surface and in the interior thereof, and therefore, have high charging performance and excellent properties.

Next, the carrier core particles obtained in the aforementioned manner are coated with resin (FIG. 1(H)). Specifically, the carrier core particles obtained according to the invention are coated with silicone-based resin, acrylic resin or the like. Thus, carrier for electrophotographic developer according to the embodiment of the invention is achieved. The silicone-based resin, acrylic resin or other coating materials can be applied through a well-known coating method. The carrier for electrophotographic developer according to the embodiment of the invention is used in developer to develop electrophotographic images and includes the above-described carrier core particles for electrophotographic developer and resin that coats the surface of the carrier core particles for electrophotographic developer. Such carrier for electrophotographic developer has high charging performance and therefore has excellent properties.

Next, predetermined amounts of the carrier and toner are mixed (FIG. 1(I)). Specifically, the carrier, which is obtained through the above-described manufacturing method, for electrophotographic developer according to the embodiment of the invention is mixed with an appropriate well-known toner. In this manner, the electrophotographic developer according to the embodiment of the invention can be achieved. The carrier and toner are mixed by any type of mixer, for example, a ball mill. The electrophotographic developer according to the embodiment of the invention is developer that is used to develop electrophotographic images and includes the above-described carrier for electrophotographic developer and toner that can be triboelectrically charged by frictional contact with the carrier for development of electrophotographic images. The electrophotographic developer including the carrier for electrophotographic developer having the aforementioned composition can form images of high quality.

EXAMPLES

Example 1

13.7 kg of $Fe_2O_3$ (average particle diameter: 1 μm), 6.5 kg of $Mn_3O_4$ (average particle diameter: 1 μm), and 2.3 kg of $MgFe_2O_4$ (average particle diameter: 3 μm) were dispersed in 7.5 kg of water, and 135 g of ammonium polycarboxylate-based dispersant, 68 g of carbon as black reducing agent, 264 g of calcium nitrate tetrahydrate ($Ca(NO_3)_2.4H_2O$) (volume mean diameter of primary particles: 0.01 μm or less) were added to make a mixture. The solid concentration of the mixture was measured and resulted in 75 wt %. The mixture was pulverized by a wet ball mill (media diameter: 2 mm) to obtain mixture slurry.

The slurry was sprayed into hot air of approximately 130° C. by a spray dryer and turned into dried granulated powder. At this stage, granulated powder particles out of the target particle size distribution were removed by a sieve. The remaining granulated powder was loaded in an electric furnace and fired at 1130° C. for 3 hours. During firing, a gas was introduced to flow into the electric furnace such that the atmosphere in the electric furnace was adjusted to have an oxygen concentration of 0.8%. The fired powder was disintegrated and then classified by a sieve to obtain carrier core particles having an average particle diameter of 25 μm. In addition, the obtained carrier core particles were maintained at 470° C. under atmosphere for 1 hour to be oxidized, thereby achieving carrier core particles according to Example 1.

The composition, magnetic properties, and electrical properties of the resultant carrier core particles are shown in Tables 1 and 2. Note that when the carrier core particles are expressed by a general formula: $(Mn_xMg_yCa_z)Fe_{3-x-y-z}O_4$, the values x, y, z of the core composition listed in Table 1 are obtained by measuring the carrier core particles through the following analysis method.

(Analysis on Mn)

The Mn content in the carrier core particles was quantitatively analyzed in conformity with a ferromanganese analysis method (potential difference titration) shown in JIS G1311-1987. The Mn content of the carrier core particles described in this invention is a quantity of Mn that was quantitatively analyzed through the ferromanganese analysis method (potential difference titration).

(Analysis on Ca and Mg)

The Ca and Mg contents in the carrier core particles were analyzed by the following method. The carrier core particles of the invention were dissolved in an acid solution and quantitatively analyzed with ICP. The contents of Ca and Mg of the carrier core particles described in this invention are quantities of Ca and Mg that were quantitatively analyzed with ICP.

Magnetization, which indicates magnetic properties, shown in Table 2 is magnetic susceptibility measured with a VSM (Model VSM-P7 produced by Toei Industry Co., Ltd.). The item "σs" in Table 2 denotes saturation magnetization, and "$\sigma_{1k\ (100)}$" indicates magnetization in an external magnetic field of 1 k (1000) Oe, "$\sigma_{500}$" indicates magnetization in an external magnetic field of 500 Oe, and "$\sigma_{2000}$" indicates magnetization in an external magnetic field of 2000 Oe. Higher $\sigma_{500}$ values denote preferable magnetization rises.

The item "core charge amount" as an electrical property in Table 2 denotes the amount of charge that the cores, or carrier core particles, can hold. Measurement of the charge amount will be described below. 9.5 g of the carrier core particles and 0.5 g of toner for commercial full-color copying machines were put in a 100-ml glass bottle with a cap and the bottle was placed in an environment at 25° C. and 50 RH % for 12 hours to control the moisture. The moisture-controlled carrier core particles and toner were shaken for 30 minutes by a shaker and mixed. The shaker in use was a model NEW-YS produced by YAYOI CO., LTD., and operated at a shaking speed of 200/min and at an angle of 60°. From the mixture of the carrier core particles and toner, 500 mg of the mixture was weighed out and measured for the charge amount by a charge measurement apparatus. In this embodiment, the measurement apparatus in use was a model STC-1-C1 produced by JAPAN PIO-TECH CO., LTD., and operated at a suction pressure of 5.0 kPa with a suction mesh made of SUS and with 795 mesh. Two samples of the same were measured and the average of the measured values was defined as the core charge amount. The core charge amount was calculated by the following formula: core charge amount (μC (coulomb)/g)=measured charge (nC)×$10^3$×coefficient ($1.0083\times10^{-3}$)÷toner weight (weight before suction (g)−weight after suction (g)).

The lattice constant was determined by the following manner. The crystal lattice constant of the magnetic carrier core particles according to the invention was measured by an X-ray diffractometer (Ultima IV produced by Rigaku Corporation). The X-ray diffractometer produces X-rays with Cu as an X-ray source, an acceleration voltage of 40 kV (kilovolt(s)), and a current of 40 mA (milliampere(s)). The powder X-ray diffraction was conducted under the following measurement conditions: the scanning mode was FT (step scanning); the divergence slit angle was 1° and the size was 10 mm; the scattering slit angle was 1°; the light-receiving slit size was 0.3 mm; the rotation speed was 5000 rpm; the scanning range was 10.000° to 120.00°; the measuring interval was 0.02°; the count time was 1 second; and the number of integration was 1. The diffraction lines to be measured were limited to those existing between 70° to 120°, and the lattice constant was determined from the resultant XRD patterns. The core particles were used as they are without grinding them, but were subjected to a pretreatment to fully expose the planes to prepare specimens. Example 1 and subsequent Examples 2 to 5 and Comparative Examples 1 and 2 all show that their particles had mono-phase, or single-phase, in the X-ray evaluations.

The ratio of calcium-segregated regions was evaluated by the following method. First, the carrier core particles for electrophotographic developer were mixed and kneaded with resin and then were cut into cross sections by a cross section polisher (SM-09010 produced by JEOL Ltd.) using argon ion laser beams under a reduced-pressure atmosphere. Next, an SEM (JSM-6390LA produced by JEOL Ltd.) and an energy dispersive X-ray spectrometry (JED-2300 produced by JEOL Ltd., with an acceleration voltage of 15 kV; 20 sweeps; and 0.2-second dwell time) were used to map the calcium composition on the obtained cross sections and to shoot an image of the entire cross section of one particle magnified 3000 times. In order to determine the ratio of calcium-segregated regions from the obtained image, software, Analysis FIVE (produced by JEOL Ltd.), was used to measure a particle's cross-sectional area $S_1$ and a cross-sectional area $S_2$ of the segregated regions. The segregated regions to be measured were defined as having a major axis of 5 mm or longer on the image when output onto an A4 sheet of paper. The percentage of the cross-sectional area $S_2$ of the segregated regions with respect to the particle's cross-sectional area $S_1$ is the ratio of the calcium-segregated regions. The particle's cross-sectional area $S_1$ includes an area of pores in the particle's cross section. More specifically, when the ratio of the calcium-segregated regions is A, the ratio of the calcium-segregated regions is calculated by $A=S_2\times100/S_1$. The aforementioned measurement was conducted for the cross sections of 100 particles, and the average value thereof is determined as the ratio of the calcium-segregated regions of the Examples and Comparative Examples.

Example 2

The carrier core particles of Example 2 were obtained in the same manner as Example 1; however, the calcium-containing raw material to be added was changed from calcium nitrate tetrahydrate ($Ca(NO_3)_2.4H_2O$) to calcium acetate monohydrate ($Ca(CH_3COO)_2.H_2O$) (volume mean diameter of primary particles: 0.01 μm or less) and the amount of the calcium acetate monohydrate added was 197 g. The composition, magnetic properties, and electrical properties of the obtained carrier core particles are shown in Tables 1 and 2.

Example 3

The carrier core particles of Example 3 were obtained in the same manner as Example 1; however, the calcium-containing raw material to be added was changed from calcium nitrate tetrahydrate ($Ca(NO_3)_2.4H_2O$) to colloidal calcium carbonate ($CaCO_3$) (volume mean diameter of primary particles: 0.04 μm). The composition, magnetic properties, and electrical properties of the obtained carrier core particles are shown in Tables 1 and 2.

Example 4

The carrier core particles of Example 4 were obtained in the same manner as Example 1; however, the calcium-containing raw material to be added was changed from calcium nitrate tetrahydrate ($Ca(NO_3)_2.4H_2O$) to calcium carbonate ($CaCO_3$) (volume mean diameter of primary particles: 0.05 μm) and the amount of the calcium carbonate added was 113 g. The composition, magnetic properties, and electrical properties of the obtained carrier core particles are shown in Tables 1 and 2.

Example 5

The carrier core particles of Example 5 were obtained in the same manner as Example 1; however, 11.0 kg of $Fe_2O_3$ (average particle diameter: 1 μm) and 4.4 kg of $Mn_3O_4$ (average particle diameter: 1 μm) were dispersed in 5.1 kg of water, and 92 g of ammonium polycarboxylate-based dispersant, 46.1 g of carbon black reducing agent, and 177 g of calcium nitrate tetrahydrate ($Ca(NO_3)_2.4H_2O$) (volume mean diameter of primary particles: 0.01 μm or less) were added. The composition, magnetic properties, and electrical properties of the obtained carrier core particles are shown in Tables 1 and 2.

Comparative Example 1

The carrier core particles of Comparative Example 1 were obtained in the same manner as Example 1; however, the calcium-containing raw material to be added was changed from calcium nitrate tetrahydrate ($Ca(NO_3)_2.4H_2O$) to calcium carbonate ($CaCO_3$) (volume mean diameter of primary particles: 1.5 μm) and the amount of the calcium carbonate added was 113 g. The composition, magnetic properties, and electrical properties of the obtained carrier core particles are shown in Tables 1 and 2.

Comparative Example 2

The carrier core particles of Comparative Example 2 were obtained in the same manner as Example 1; however, the calcium-containing raw material to be added was changed from calcium nitrate tetrahydrate ($Ca(NO_3)_2.4H_2O$) to calcium carbonate ($CaCO_3$) (volume mean diameter of primary particles: 4 μm) and the amount of the calcium carbonate added was 113 g. The composition, magnetic properties, and electrical properties of the obtained carrier core particles are shown in Tables 1 and 2.

TABLE 1

| | CALCIUM-CONTAINING RAW MATERIAL | VOLUME MEAN DIAMETER μm | COMPOSITION Fe wt % | Mn wt % | Mg wt % | Ca wt % | $(Mn_xMg_yCa_z)Fe_{3-x-y-z}O_4$ 3 − x − y − z | x | y | z |
|---|---|---|---|---|---|---|---|---|---|---|
| EXAMPLE 1 | CALCIUM NITRATE | <0.01 | 47.72 | 20.00 | 1.34 | 0.21 | 2.00 | 0.85 | 0.13 | 0.01 |
| EXAMPLE 2 | CALCIUM ACETATE | <0.01 | 47.40 | 20.27 | 1.35 | 0.20 | 1.99 | 0.87 | 0.13 | 0.01 |
| EXAMPLE 3 | COLLOIDAL CALCIUM CARBONATE | 0.04 | 47.77 | 20.33 | 1.32 | 0.20 | 2.00 | 0.86 | 0.13 | 0.01 |
| EXAMPLE 4 | CALCIUM CARBONATE | 0.05 | 47.47 | 20.10 | 1.31 | 0.20 | 2.00 | 0.86 | 0.13 | 0.01 |
| EXAMPLE 5 | CALCIUM NITRATE | <0.01 | 49.56 | 19.80 | 0.18 | 0.21 | 2.07 | 0.87 | 0.02 | 0.04 |
| COMPARATIVE EXAMPLE 1 | CALCIUM CARBONATE | 1.5 | 47.82 | 19.84 | 1.31 | 0.20 | 2.01 | 0.85 | 0.13 | 0.01 |
| COMPARATIVE EXAMPLE 2 | CALCIUM CARBONATE | 4 | 47.72 | 20.00 | 1.33 | 0.21 | 2.01 | 0.85 | 0.13 | 0.01 |

TABLE 2

| | MAGNETIC PROPERTIES $\sigma_s$ emu/g | $\sigma_{2k}$ emu/g | $\sigma_{1k}$ emu/g | $\sigma_{500}$ emu/g | $\sigma_\gamma$ emu/g | Hc Oe | ELECTRICAL PROPERTIES CORE CHARGE AMOUNT μC/g | LATTICE CONSTANT | X-RAY EVALUATION | RATIO OF SEGREGATED CALCIUM REGIONS % |
|---|---|---|---|---|---|---|---|---|---|---|
| EXAMPLE 1 | 69.0 | 66.5 | 59.6 | 40.6 | 1.0 | 9.9 | 22.5 | 8.498 | MONO-PHASE | 0.9 |
| EXAMPLE 2 | 69.0 | 66.5 | 59.8 | 41.7 | 1.0 | 10.7 | 22.2 | 8.495 | MONO-PHASE | 1.0 |
| EXAMPLE 3 | 70.9 | 68.4 | 61.1 | 41.4 | 0.8 | 8.5 | 21.2 | 8.496 | MONO-PHASE | 2.4 |
| EXAMPLE 4 | 70.5 | 67.9 | 60.4 | 40.9 | 0.9 | 9.8 | 20.9 | 8.492 | MONO-PHASE | 3.0 |
| EXAMPLE 5 | 68.0 | 65.7 | 58.9 | 39.6 | 1.0 | 11.9 | 22.0 | 8.501 | MONO-PHASE | 0.9 |
| COMPARATIVE EXAMPLE 1 | 69.0 | 66.5 | 59.6 | 40.6 | 1.0 | 9.9 | 16.5 | 8.490 | MONO-PHASE | 5.6 |
| COMPARATIVE EXAMPLE 2 | 70.9 | 68.5 | 60.9 | 40.7 | 0.8 | 8.5 | 13.2 | 8.488 | MONO-PHASE | 6.0 |

Referring to the magnetic properties in Tables 1 and 2, Examples 1 to 5 have high $\sigma_{500}$ values, specifically, 40.6 emu/g, 41.7 emu/g, 41.4 emu/g, 40.9 emu/g, and 39.6 emu/g, respectively. Especially, Examples 1 to 4, whose composition is based on MnMg (manganese magnesium), have $\sigma_{500}$ values of 40.5 emu/g or higher, which demonstrates that the MnMg-base composition is preferable in order to achieve a desired magnetization rise in lower magnetic fields.

Regarding electrical properties, Comparative Examples 1 and 2 have core charge amounts of 16.5 μC/g and 13.2 μC/g, respectively, while the core charge amounts of Examples 1 to 5 are 22.5 μC/g, 22.2 μC/g, 21.2 μC/g, 20.9 μC/g, and 22.0 μC/g, respectively, which are all 20.0 μC/g or higher. As compared with the carrier core particles in Comparative Examples 1 and 2, the carrier core particles in Examples 1 to 5 have improved magnetic properties and improved charging performance, that is, electrical properties.

Figure 2:
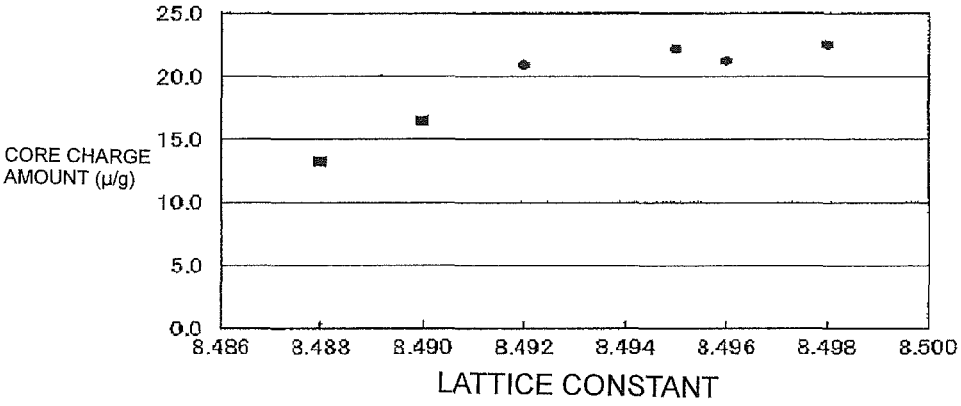
FIG. 2 is a graph showing the relationship between core charge amounts and lattice constants.

FIG. 2 is a graph showing the relationship between core charge amounts and lattice constants of above-described Examples and Comparative Examples. In FIG. 2, the vertical axis represents core charge amounts, while the horizontal axis represents lattice constants. In the graph shown in FIG. 2, black dots indicate Examples, while black squares indicate Comparative Examples.

Referring to FIG. 2, Comparative Examples 1 and 2 exhibit low lattice constants, specifically, 8.490 and 8.488, respectively, both being 8.490 or lower. Comparative Examples 1 and 2 also exhibit low core charge amounts, specifically, 16.5 μC/g and 13.2 μC/g, respectively, both being 18.0 μC/g or lower. On the other hand, Examples 1 to 5 have high lattice constants, specifically, 8.498, 8.495, 8.496, 8.492, and 8.501. Examples 1 to 5 also have high core charge amounts, specifically, 22.5 μC/g, 22.2 μC/g, 21.2 μC/g, 20.9 μC/g, and 22.0 μC/g, respectively, all being 20.0 μC/g or higher. Especially, Examples 1, 2 and 5, each having a volume mean diameter of 0.01 μm or less, have core charge amounts of 22.0 μC/g or higher. These results show that it is preferable to make the volume mean diameter as small as possible in order for the carrier core particles to hold large amounts of charge. In other words, if the primary particles of calcium-containing raw material are made to have a volume mean diameter of 1 μm or less, the value of the core charge amount can be higher than at least 16.5 μC/g, which is the charge amount of the carrier core particles of Comparative Example 1. Making the volume mean diameter of primary particles of the calcium-containing raw material be 0.1 μm or less can provide carrier core particles having a charge amount close to that of the Examples. It is also apparent from FIG. 2 that the carrier core particles having higher lattice constants exhibit higher core charge amounts, which demonstrates the charge that carrier core particles can hold increases with an increase in the lattice constant. The carrier core particles for electrophotographic developer according to the embodiment of the invention are carrier core particles that contain iron, manganese, and calcium as a core composition and have a lattice constant higher than 8.490. Such carrier core particles contain calcium forming a good solid solution with a spinel structure, and therefore the properties are excellent.

Figure 3:
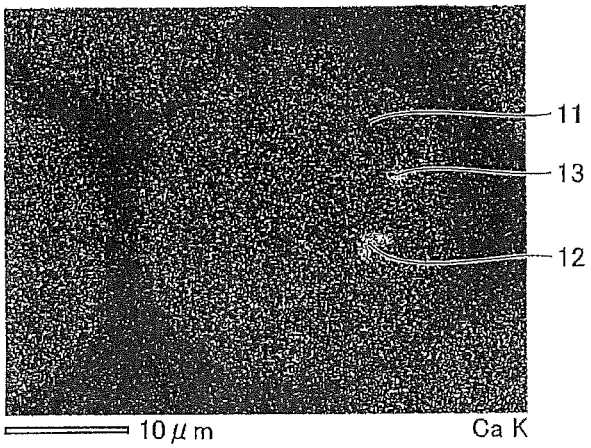
FIG. 3 shows an EDX elemental analysis result of a Ca element of a carrier core particle of Example 1 within a visible range of the electron micrograph.
Figure 4:
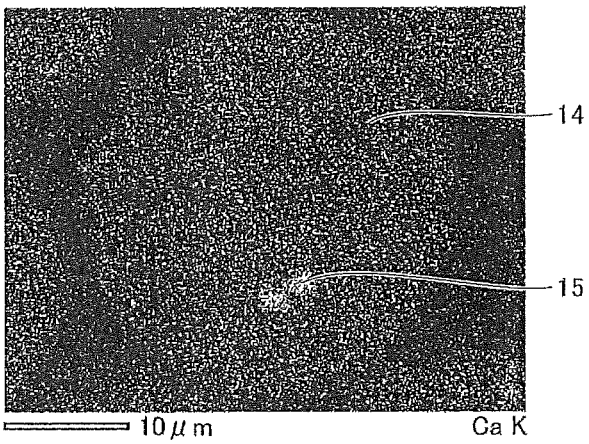
FIG. 4 shows an EDX elemental analysis result of a Ca element of a carrier core particle of Example 2 within a visible range of the electron micrograph.
Figure 5:
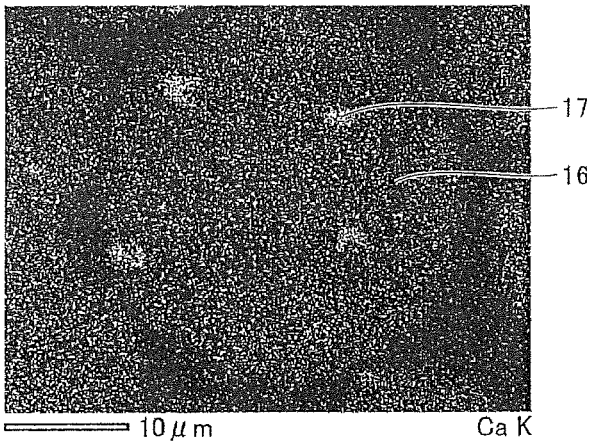
FIG. 5 shows an EDX elemental analysis result of a Ca element of a carrier core particle of Example 3 within a visible range of the electron micrograph.
Figure 6:
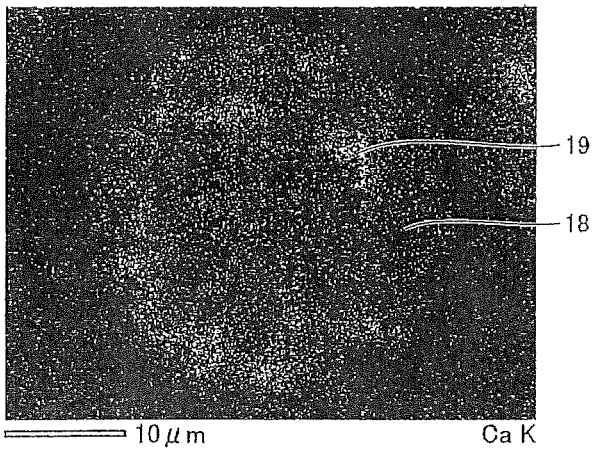
FIG. 6 shows an EDX elemental analysis result of a Ca element of a carrier core particle of Comparative Example 1 within a visible range of the electron micrograph.
Figure 7:
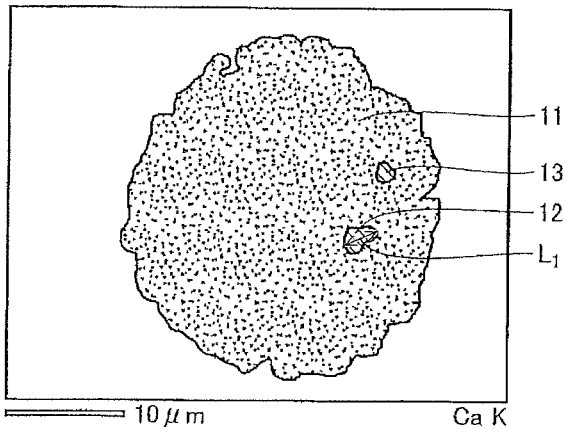
FIG. 7 is a schematic view showing the EDX elemental analysis result of the Ca element of the carrier core particle of Example 1 within the visible range of the electron micrograph.
Figure 8:
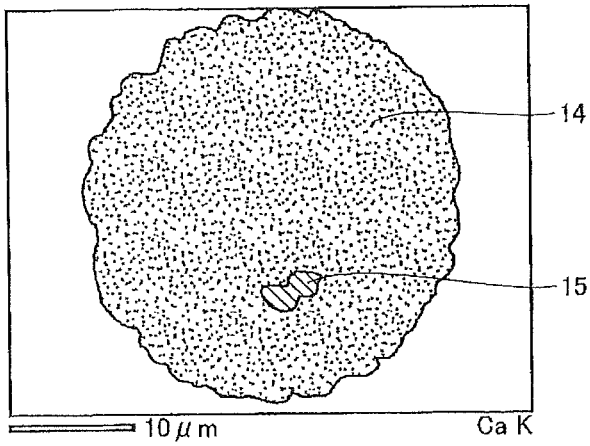
FIG. 8 is a schematic view showing the EDX elemental analysis result of the Ca element of the carrier core particle of Example 2 within the visible range of the electron micrograph.
Figure 9:
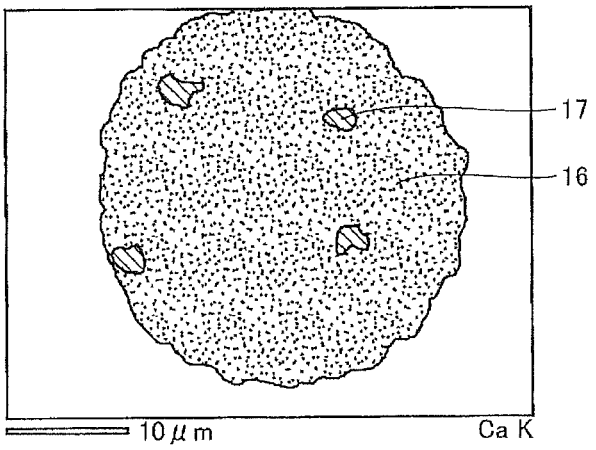
FIG. 9 is a schematic view showing the EDX elemental analysis result of the Ca element of the carrier core particle of Example 3 within the visible range of the electron micrograph.
Figure 10:
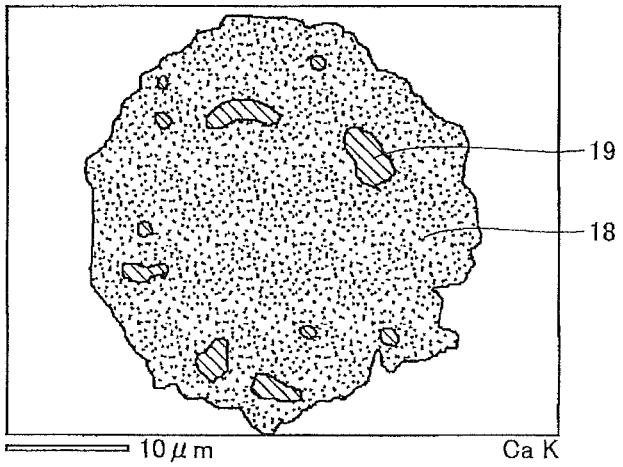
FIG. 10 is a schematic view showing the EDX elemental analysis result of the Ca element of the carrier core particle of Comparative Example 1 within the visible range of the electron micrograph.

FIG. 3 shows an EDX elemental analysis result of a Ca element of a carrier core particle of Example 1 within a visible range of the electron micrograph. FIG. 4 shows an EDX elemental analysis result of a Ca element of a carrier core particle of Example 2 within a visible range of the electron micrograph. FIG. 5 shows an EDX elemental analysis result of a Ca element of a carrier core particle of Example 3 within a visible range of the electron micrograph. FIG. 6 shows an EDX elemental analysis result of a Ca element of a carrier core particle of Comparative Example 1 within a visible range of the electron micrograph. FIG. 7 is a schematic view showing the EDX elemental analysis result of the Ca element of the carrier core particle shown in FIG. 3 within the visible range of the electron micrograph. FIG. 8 is a schematic view showing the EDX elemental analysis result of the Ca element of the carrier core particle shown in FIG. 4 within the visible range of the electron micrograph. FIG. 9 is a schematic view showing the EDX elemental analysis result of the Ca element of the carrier core particle shown in FIG. 5 within the visible range of the electron micrograph. FIG. 10 is a schematic view showing the EDX elemental analysis result of the Ca element of the carrier core particle shown in FIG. 6 within the visible range of the electron micrograph.

From Table 2 and other data, it can be appreciated that the ratio of the Ca-segregated regions tends to increase with an increase in volume mean diameter of primary particles. It can be also assumed that there is some correlation between degrees of segregation of calcium and core charge amounts. Specifically, the core charge amount is assumed to decrease as the ratio of calcium-segregated regions increases. The ratios of the calcium-segregated regions of Examples 1 to 5 are all 4% or less, while Comparative Example 1 exhibits 5.6% and Comparative Example 2 exhibits 6.0%. The carrier core particles according to the embodiment of the invention are carrier core particles for electrophotographic developer containing iron, manganese, and calcium as a core composition, and when observing a cross sections of the carrier core particles for electrophotographic developer that is magnified 3000 times by an electron microscope and mapped for a calcium element by an EDX (Energy Dispersive X-ray Spectroscopy), calcium-segregated regions account for 4% or less of the entire cross section.

Next, carrier for electrophotographic developer and electrophotographic developer were produced with the resultant carrier core particles and evaluated. The evaluation results are shown in Table 3.

TABLE 3

| | INITIAL STAGE | | | | 100K COPIES | | | | 200K COPIES | | | |
|---|---|---|---|---|---|---|---|---|---|---|---|---|
| | IMAGE DENSITY | FOG LEVEL | FINE LINE REPRODUCIBILITY | IMAGE QUALITY | IMAGE DENSITY | FOG LEVEL | FINE LINE REPRODUCIBILITY | IMAGE QUALITY | IMAGE DENSITY | FOG LEVEL | FINE LINE REPRODUCIBILITY | IMAGE QUALITY |
| EXAMPLE 1 | ◎ | ◎ | ◎ | ◎ | ◎ | ◎ | ○ | ◎ | ◎ | ○ | ○ | ◎ |
| EXAMPLE 2 | ◎ | ◎ | ◎ | ◎ | ◎ | ○ | ◎ | ◎ | ◎ | ○ | ○ | ◎ |
| EXAMPLE 3 | ◎ | ◎ | ◎ | ◎ | ◎ | ○ | ◎ | ◎ | ◎ | ○ | ◎ | ◎ |
| EXAMPLE 4 | ◎ | ◎ | ◎ | ◎ | ◎ | ○ | ○ | ◎ | ◎ | ○ | ○ | ○ |
| EXAMPLE 5 | ◎ | ◎ | ◎ | ◎ | ◎ | ○ | ◎ | ◎ | ◎ | ○ | ◎ | ○ |
| COMPARATIVE EXAMPLE 1 | ◎ | ○ | ◎ | ◎ | ○ | ○ | X | Δ | X | Δ | X | X |
| COMPARATIVE EXAMPLE 2 | ○ | ◎ | ◎ | ◎ | Δ | X | X | X | X | X | X | X |

In FIGS. 7 to 10, hatched regions 12, 15, 17, 19 indicate regions where Ca is segregated. Dot regions 11, 14, 16, 18 indicate regions where Ca is not segregated. Among region 12 in FIG. 7, a region with a major axis having a length L1 of 5 mm or longer is defined as a Ca-segregated region. That is, the hatched region 13 in FIG. 7 has a major axis shorter than 5 mm and is not defined as a calcium-segregated region. In FIG. 7, the aforementioned particle's cross-sectional area $S_1$ is equal to a combined total for the regions 11, 12, 13, while the cross-sectional area $S_2$ of the segregated regions is equal to the region 12.

FIGS. 3 to 10 and Table 2 reveal that Example 1 has Ca-segregated regions 12 and 15, but they are very small. It is estimated from the data in Table 2 that Examples 2 and 5 have the same tendency as Example 1. As to Example 3, it is found that the Ca-segregated regions 17 are relatively small. It is also assumed from the data in Table 2 that Example 4 has the same tendency as Example 3. On the other hand, it is found that Comparative Example 1 has many Ca-segregated regions 19. It also can be assumed from the data in Table 2 that Comparative Example 2 has the same tendency as Comparative Example 1.

Now, a method for manufacturing carrier for electrophotographic developer will be described. The carrier core particles were coated with resin by the following method. Silicone-based resin (trade name: KR251 produced by Shin-Etsu Chemical Co., Ltd.) was dissolved in toluene to prepare a coating resin solution. Then, the carrier core particles obtained as above and the prepared coating resin solution in a 9:1 weight ratio were loaded in an agitator that in turn agitated and heated the carrier core particles immersed in the coating resin solution for 3 hours at a temperature of 150° C. to 250° C. This produced carrier core particles coated with the resin at a ratio of 1.0 wt % relative to the weight of carrier core particles. The resin-covered (coated) carrier core particles were placed in a circulating hot air oven and heated at 250° C. for 5 hours to cure the coating resin, thereby obtaining carrier for electrophotographic developer according to Example 1.

The carrier particles for electrophotographic developer and commercial toner particles with a diameter of a few μm were mixed in a V-shape mixer or a pot mill to obtain electrophotographic developer. With the electrophotographic developer obtained as above, the image characteristics were evaluated.

With the use of a digital reversal development-type test machine operable at a copy speed of 60 copies per minute as an evaluation machine and the electrophotographic developer obtained above, printing durability tests were conducted for evaluating the image characteristics, including carrier scattering, image density, fog level, fine line reproducibility, and image quality, from the initial stage to after formation of 200K (K=1000) copies. Among the evaluation items, "image quality" indicates evaluation as a whole. The electrophotographic developers were rated on a scale of Very good ◎ (double circle); Good ○ (circle); Usable Δ (triangle); and Unusable x (cross) on the evaluation criteria. The scale "○ (circle)" is equivalent to a level of currently commercially practical high performance electrophotographic developer, and therefore electrophotographic developers rated as "○ (circle)" or higher are judged as passable.

Referring to Table 3, the electrophotographic developers according to Examples 1 to 5 maintain the image density, fog level, fine line reproducibility, and image quality at the very good level or good level not only at the initial stage, but also after formation of 100K copies and 200K copies. On the other hand, Comparative Examples 1 and 2 are at a very good level or good level in terms of image density, fog level, fine line reproducibility, and image quality at an initial stage, but some items are at a usable level or unusable level after formation of 100K copies, and the number of the usable level and unusable level increases after formation of 200K copies.

The above descriptions demonstrate the excellent properties of the carrier core particles for electrophotographic developer, carrier for electrophotographic developer and electrophotographic developer according to the invention.

The manufacturing method according to the embodiment includes preparing and mixing an iron-containing raw material, a manganese-containing raw material, a calcium-containing raw material, and a magnesium-containing raw material to provide carrier core particles according to the invention; however, the invention is not limited thereto, and the carrier core particles according to the invention can be provided by preparing and mixing, for example, metal oxides of Si, such as Ca $SiO_3$.

Although magnesium is used as a raw material of the carrier core particles in the above-described embodiment, the carrier core particles can be made without magnesium.

Although the calcium-containing raw material in a solution state is mixed in the mixing step according to the embodiment; the present invention is not limited thereto, and the calcium-containing raw material in a powdery state can be mixed as it is.

As to the oxygen amount in the aforementioned embodiment, the oxygen concentration in the cooling process of the firing step is set higher than a predetermined concentration in order to have the carrier core particles contain an excess amount of oxygen; however, the present invention is not limited thereto, and, for example, adjustment of the compounding ratio made in the raw material mixing step also allows the carrier core particles to contain an excess amount of oxygen. In addition, the carrier core particles can contain an excess amount of oxygen by performing a step of promoting sintering reaction, which is performed before the cooling process, under the same atmosphere as the cooling process.

The foregoing has described the embodiment of the present invention by referring to the drawings. However, the invention should not be limited to the illustrated embodiments. It should be appreciated that various modifications and changes can be made to the illustrated embodiments within the scope of the appended claims and their equivalents.

INDUSTRIAL APPLICABILITY

The carrier core particles for electrophotographic developer, carrier for electrophotographic developer and electrophotographic developer according to the invention can be effectively used when applied to copying machines or the like that require high image quality.

REFERENCE SIGNS LIST

11, 12, 13, 14, 15, 16, 17, 18, 19: region.

The invention claimed is:

1. Carrier core particles for electrophotographic developer comprising iron, manganese and calcium as a core composition, wherein the carrier core particles have a lattice constant higher than or equal to 8.492, and further wherein when observing a cross section of the carrier core particles for electrophotographic developer that is magnified 3000 times by an electron microscope and mapped for a calcium element by an EDX (Energy Dispersive X-ray Spectroscopy), calcium-segregated regions account for 4% or less of the entire cross section.

2. The carrier core particles for electrophotographic developer according to claim 1, wherein the calcium-segregated regions account for 3% or less of the entire cross section.

3. Carrier for electrophotographic developer used in developer to develop electrophotographic images, comprising:

carrier core particles for electrophotographic developer cited in claim 1; and resin that coats the surface of the carrier core particles for electrophotographic developer.

4. Electrophotographic developer used to develop electrophotographic images, comprising:

the carrier for electrophotographic developer cited in claim 3; and toner that can be triboelectrically charged by frictional contact with the carrier for development of electrophotographic images.

* * * * *